US011142011B2

(12) United States Patent
Kosuge et al.

(10) Patent No.: US 11,142,011 B2
(45) Date of Patent: Oct. 12, 2021

(54) TAPE PRINTING APPARATUS

(71) Applicant: SEIKO EPSON CORPORATION, Tokyo (JP)

(72) Inventors: Shinsaku Kosuge, Matsumoto (JP); Taishi Sasaki, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/832,942

(22) Filed: Mar. 27, 2020

(65) Prior Publication Data

US 2020/0307292 A1 Oct. 1, 2020

(30) Foreign Application Priority Data

Mar. 28, 2019 (JP) ..... JP2019-064025

(51) Int. Cl.
*B41J 2/32* (2006.01)
*B41J 32/02* (2006.01)

(52) U.S. Cl.
CPC ..... *B41J 32/02* (2013.01); *B41J 2/32* (2013.01)

(58) Field of Classification Search
CPC . B41J 32/02; B41J 15/044; B41J 15/02; B41J 3/4075; B41J 29/38; B41J 32/00; B41J 17/32; B41J 2/32; B41J 2/235; B65H 19/12
See application file for complete search history.

(56) References Cited

U.S. PATENT DOCUMENTS 5,702,192 A * 12/1997 Matsuhashi ..... B41J 2/325 400/586
8,162,553 B2 * 4/2012 Vandermeulen ..... B41J 15/044 400/613
2004/0161278 A1 8/2004 Harada
2008/0080922 A1 4/2008 Vandermeulen
2017/0106678 A1 * 4/2017 Sakano ..... B41J 15/044
2018/0297374 A1 * 10/2018 Sasaki ..... B41J 2/325

FOREIGN PATENT DOCUMENTS

CN 101022956 A 8/2007
CN 207868823 U 9/2018
JP 2001-278510 A 10/2001
JP 2002-361962 A 12/2002

* cited by examiner

*Primary Examiner* — Kristal Feggins
(74) *Attorney, Agent, or Firm* — Oliff PLC

(57) ABSTRACT

A tape printing apparatus including three holding protrusions that are provided on a mounting portion cover and that hold a cartridge mounted in a cartridge mounting portion, a displacement member that, when the cartridge is mounted in the cartridge mounting portion, is displaced from a protruded position to a lower-side position by having the cartridge abut against a cartridge abutment portion, and an elastic member that applies force to the displacement member towards an opposite direction to a mounting direction. In the tape printing apparatus, when viewed from the mounting direction, the cartridge abutment portion is provided inside a virtual holding triangle having holding distal end portions that are distal end portions of the three holding protrusions as apexes.

6 Claims, 15 Drawing Sheets

FIG. 15

| FIRST SENSOR | SUBSTRATE MOUNTING PORTION | SECOND SENSOR | DETERMINATION RESULT |
|---|---|---|---|
| 0 | 0 | 0 | NOT MOUNTED |
| 1 | 0 | 0 | TAPE CARTRIDGE: MOUNTED APPROPRIATELY |
| 1 | 1 | 1 | RIBBON CARTRIDGE: MOUNTED APPROPRIATELY |
| 1 | 0 | 1 | RIBBON CARTRIDGE: ABNORMALITY IN CIRCUIT SUBSTRATE |
| 1 | 1 | 0 | RIBBON CARTRIDGE: ABNORMALITY IN MOUNTING |
| 0 | 1 | 1 | RIBBON CARTRIDGE: ABNORMALITY IN MOUNTING |
| 0 | 1 | 0 | RIBBON CARTRIDGE: ABNORMALITY IN MOUNTING |
| 0 | 0 | 1 | RIBBON CARTRIDGE: ABNORMALITY IN MOUNTING |

TAPE PRINTING APPARATUS

The present application is based on, and claims priority from JP Application Serial Number 2019-064025, filed Mar. 28, 2019, the disclosure of which is hereby incorporated by reference herein in its entirety.

BACKGROUND

1. Technical Field

This application relates to a tape printing apparatus in which a cartridge is mounted.

2. Related Art

Hitherto, as disclosed in JP-A-2001-278510, a tape printer that includes an engagement protrusion inserted through a reel hole of a small cassette when the small cassette is mounted in a cassette mounting portion is known. The engagement protrusion is provided so as to be capable of rising from and falling to a bottom portion of the cassette mounting portion. Force standing the engagement protrusion on the bottom surface of the cassette mounting portion is applied with a spring. Furthermore, when a large cassette is mounted in the cassette mounting portion, the engagement protrusion pushed by the large cassette retracts into a protrusion accommodating recess so that the engagement protrusion does not obstruct the mounting of the large cassette.

In the known tape printer, when the large cassette is mounted in the cassette mounting portion, the large cassette may be positionally deviated towards the opposite direction to the mounting direction with respect to the desired mounting position due to the large cassette being pushed towards the opposite direction to the mounting direction by the engagement protrusion to which force that stands the engagement protrusion is applied by the spring.

SUMMARY

A tape printing apparatus according to the disclosed embodiment includes a cartridge mounting portion in which the cartridge is mounted, a mounting portion cover that opens/closes the cartridge mounting portion, three holding protrusions provided on the mounting portion cover, while in a state in which the cartridge is mounted in the cartridge mounting portion, when the mounting portion cover is closed, the three holding protrusions hold the cartridge, a displacement member that includes a cartridge abutment portion against which the cartridge abuts when the cartridge is mounted in the cartridge mounting portion, the displacement member being displaced from a protruded position, in which the displacement member protrudes from a mounting bottom surface or a bottom surface of the cartridge mounting portion, to a lower-side position, in which the displacement member is displaced from the protruded position towards a mounting direction of the cartridge, by having the cartridge abut against the cartridge abutment portion, and an elastic member that applies force to the displacement member towards opposite direction to the mounting direction. In the tape printing apparatus, when viewed from the mounting direction, the cartridge abutment portion is provided inside a virtual holding triangle having distal end portions of the three holding protrusions serve as apexes when the mounting portion cover is in a closed state.

BRIEF DESCRIPTION OF THE DRAWINGS

FIG. 15 is a diagram illustrating determination results of a control unit based on detection signals output from a first sensor, a substrate connection portion, and a second sensor.

DESCRIPTION OF EXEMPLARY EMBODIMENTS

Hereinafter, an exemplary embodiment of a tape printing apparatus will be described with reference to the accompanying drawings. Note that X–Y–Z rectangular coordinate systems in the following drawings are illustrated merely for convenience of description and do not limit the exemplary embodiment hereinafter in any way. Furthermore, the numerical values indicating the number of portions are described merely as examples and do not limit the exemplary embodiment below in any way.

Outlines of Tape Printing Apparatus, Tape Cartridge, and Ribbon Cartridge

Figure 1:
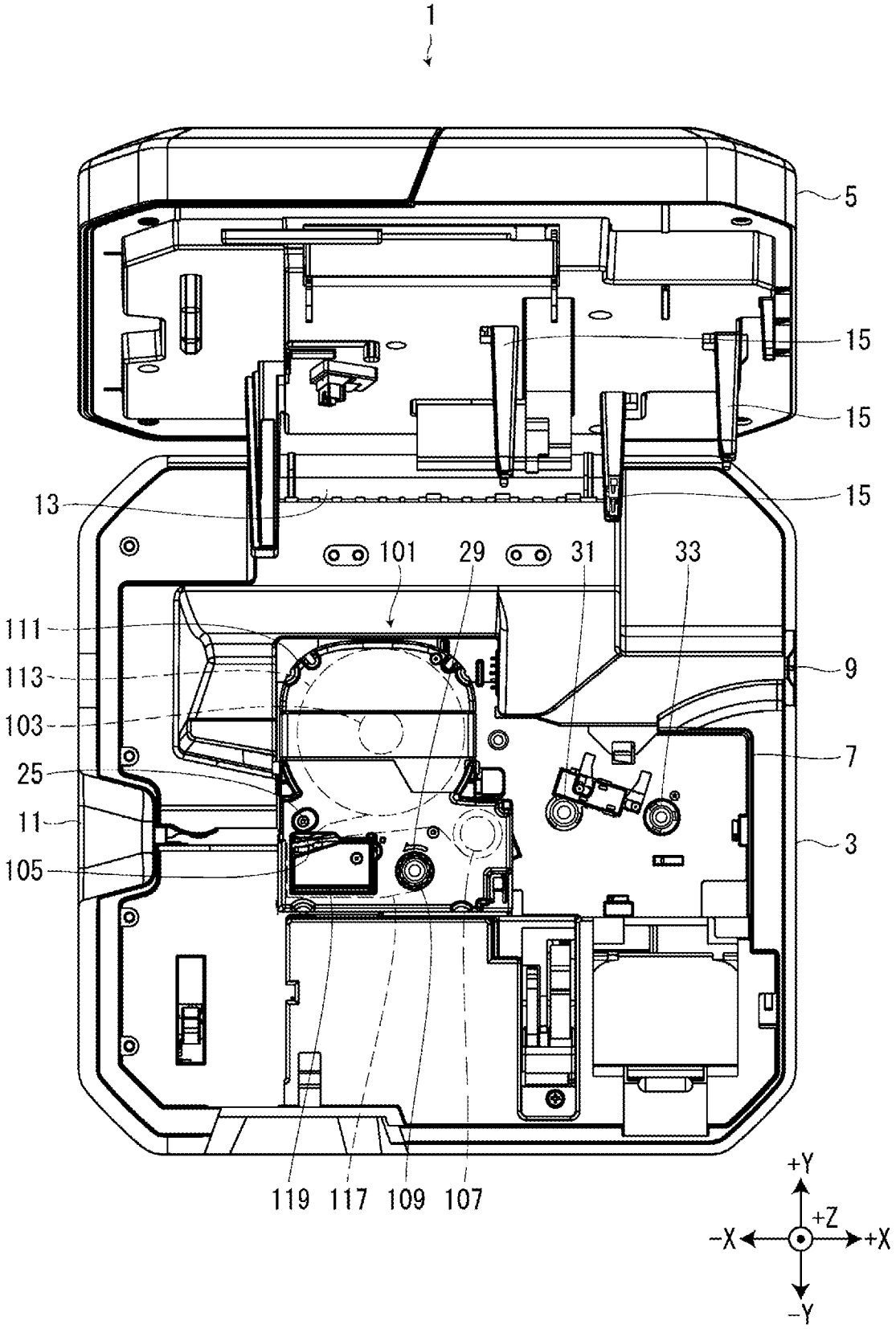
FIG. 1 is a diagram of a tape printing apparatus viewed from a mounting direction and in which a tape cartridge is mounted in a cartridge mounting portion.
Figure 2:
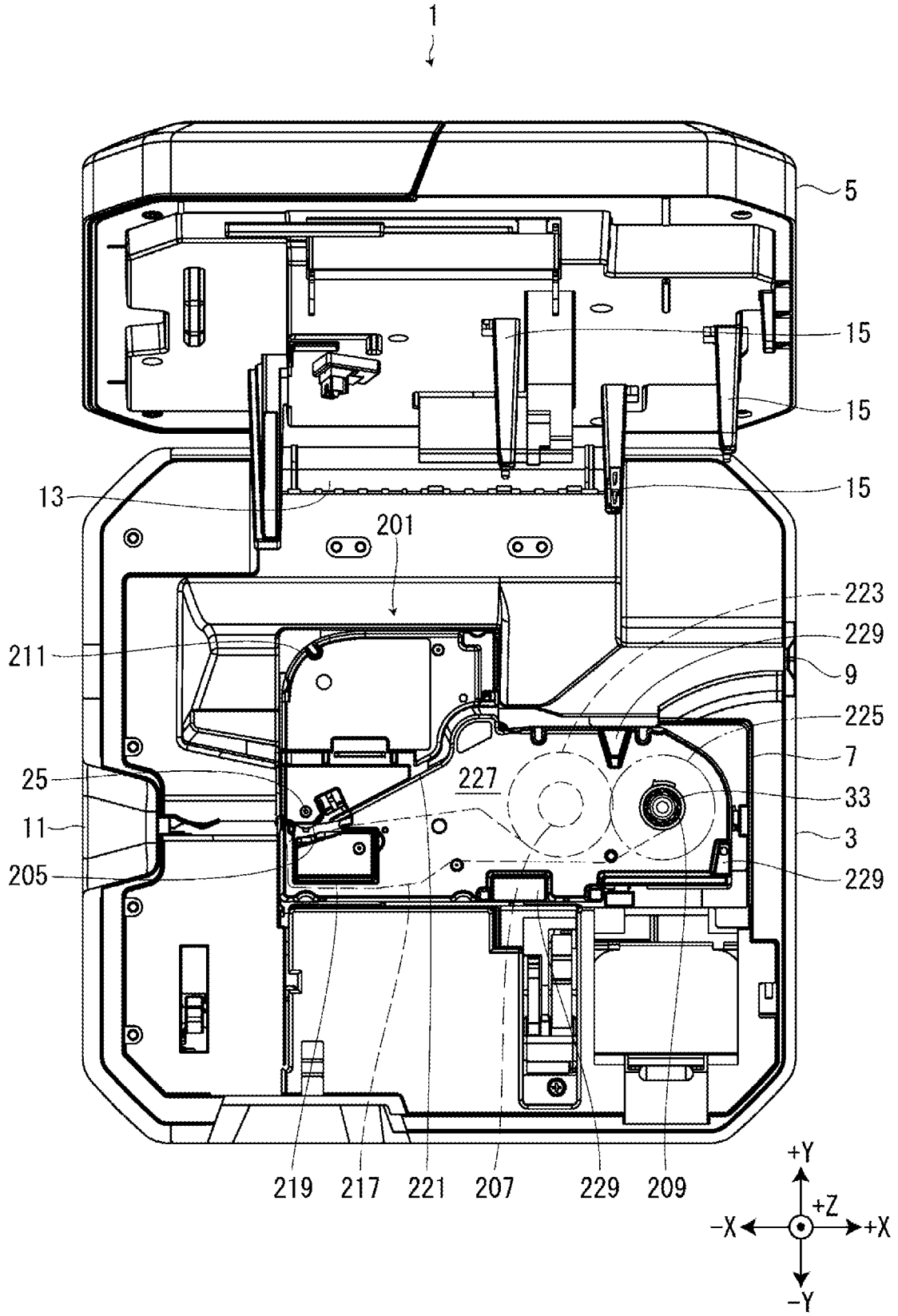
FIG. 2 is a diagram of the tape printing apparatus viewed from the mounting direction and in which a ribbon cartridge is mounted in the cartridge mounting portion.

As illustrated in FIGS. 1 and 2, a tape printing apparatus 1 includes an apparatus case 3 and a mounting portion cover 5. The apparatus case 3 is formed in a substantially rectangular parallelepiped shape. A cartridge mounting portion 7 is provided on a surface of the apparatus case 3 on a +Z side. A tape cartridge 101 (see FIG. 1) or a ribbon cartridge 201 (see FIG. 2) is selectively mounted in the cartridge mounting portion 7. Note that the tape cartridge 101 is an example of a "non-contact cartridge", and the ribbon cartridge 201 is an example of a "cartridge".

A tape introduction port 9 is provided in a surface of the apparatus case 3 on the +X side. When the ribbon cartridge 201 is mounted in the cartridge mounting portion 7, a second print tape (not shown) sent out from a tape roll provided external to the tape printing apparatus 1 is introduced through the tape introduction port 9. A tape discharge port 11 is provided in a surface of the apparatus case 3 on a −X side. A first print tape 113 sent out from the tape cartridge 101 mounted in the cartridge mounting portion 7 or the second print tape introduced through the tape introduction port 9 is discharged through the tape discharge port 11.

The mounting portion cover 5 opens/closes the cartridge mounting portion 7. The mounting portion cover 5 is attached to the apparatus case 3 in a pivotable manner about a hinge portion 13 provided at an end portion on a +Y side. Three holding protrusions 15 are provided on an inner surface of the mounting portion cover 5. Note that while not illustrated in the drawings, a keyboard and a display are provided inside the mounting portion cover 5. The keyboard receives input operations including print information such as character strings and the like, and various instructions such as printing. The display displays various pieces of information in addition to the print information input through the keyboard.

As illustrated in FIG. 1, the tape cartridge 101 includes a tape core 103, a first platen roller 105, a first paying out core 107, a first winding core 109, and a first cartridge case 111 that houses the above members. The first print tape 113 is wound around the tape core 103. The first print tape 113 sent out from the tape core 103 is sent out to a portion external to the first cartridge case 111 through a tape outlet port (not shown) provided in a peripheral wall portion of the first cartridge case 111 on the −X side. A first ink ribbon 117 is wound around the first paying out core 107. The first ink ribbon 117 sent out from the first paying out core 107 is wound by the first winding core 109. A first head insertion hole 119 is provided so as to penetrate through the first cartridge case 111 in a Z direction.

As illustrated in FIG. 2, the ribbon cartridge 201 includes a second platen roller 205, a second paying out core 207, a second winding core 209, and a second cartridge case 211 that houses the above members. A second ink ribbon 217 is wound around the second paying out core 207. The second ink ribbon 217 sent out from the second paying out core 207 is wound by the second winding core 209. A second head insertion hole 219 is provided so as to penetrate the second cartridge case 211 in the Z direction. Furthermore, a second tape path 221 is provided in the second cartridge case 211. The second print tape introduced through the tape introduction port 9 passes through the second tape path 221 and is sent to the tape discharge port 11.

Note that when the entire second ink ribbon 217 is wound around the second paying out core 207, the second ink ribbon 217 wound around the second paying out core 207 is referred to as a maximum-diameter paying-out-side roll 223. Furthermore, when the entire second ink ribbon 217 is wound around the second winding core 209, the second ink ribbon 217 wound around the second winding core 209 is referred to as a maximum-diameter winding-side roll 225. Note that while in FIG. 2, the entire second ink ribbon 217 is wound around the second paying out core 207, the maximum-diameter winding-side roll 225 is virtually illustrated by a two-dot chain line.

Note that the length of the second print tape in an unused tape roll and the length of the second ink ribbon 217 housed inside an unused ribbon cartridge 201 are not limited to any lengths in particular; however, in the present exemplary embodiment, the above lengths are longer than the length of the first print tape 113 and the length of the first ink ribbon 117 that are housed inside an unused tape cartridge 101. Accordingly, for example, when making a large number of labels all at once, the ribbon cartridge 201 is mounted in the cartridge mounting portion 7.

Cartridge Mounting Portion

Figure 3:
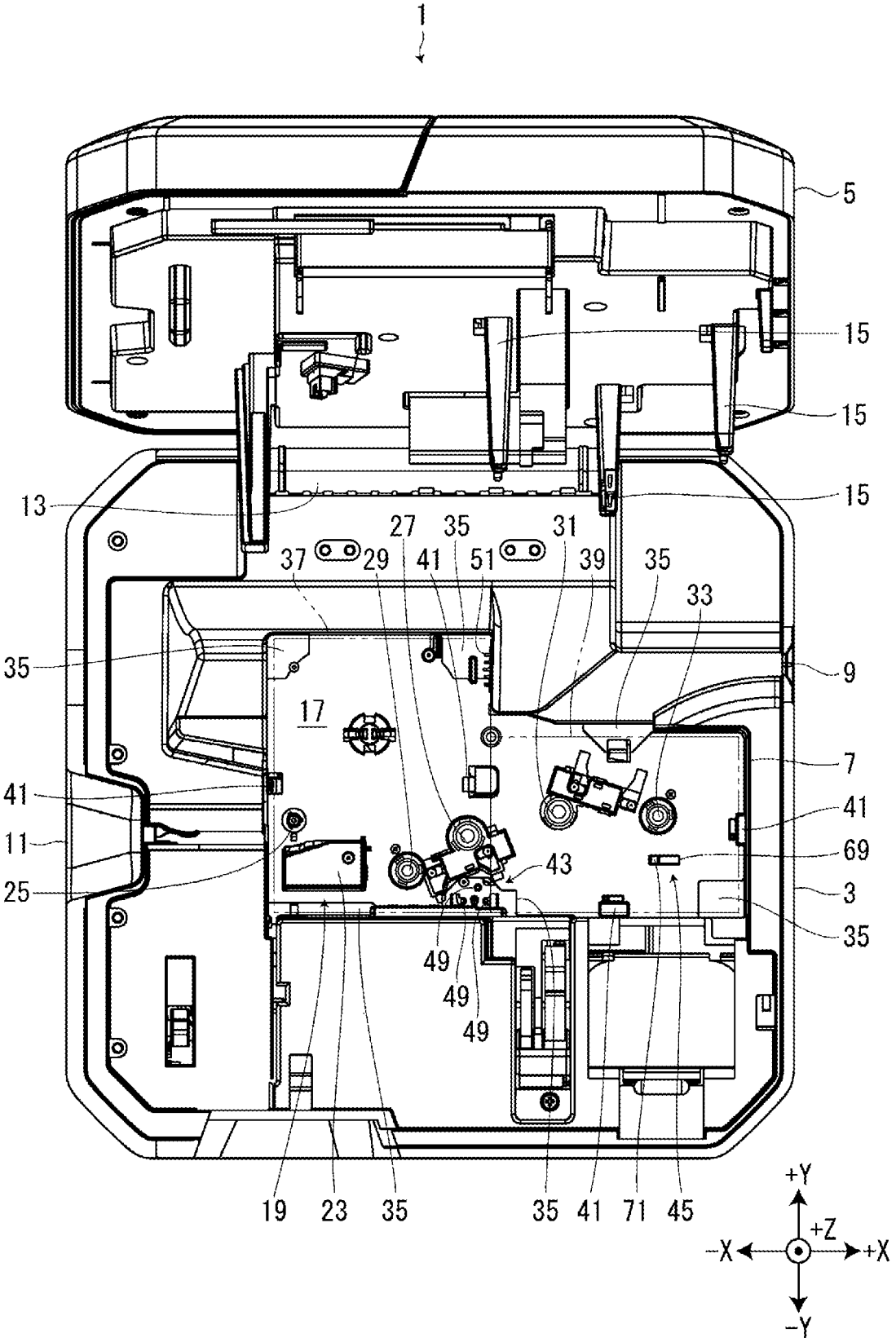
FIG. 3 is a diagram of the tape printing apparatus viewed from the mounting direction and in which neither the tape cartridge nor the ribbon cartridge is mounted in the cartridge mounting portion.

As illustrated in FIG. 3, the cartridge mounting portion 7 is formed in a recessed shape in which a +Z side is open. A head portion 19 is provided on a mounting bottom surface 17 that is a bottom surface, or a surface on a −Z side, of the cartridge mounting portion 7. The head portion 19 is provided so as to protrude towards the +Z side (see FIG. 6). The head portion 19 includes a print head 21 (see FIG. 6) and a head cover 23 that covers at least the +X side, a −Y side, and the +Z side of the print head 21. The print head 21 is a thermal head including a heating element. The head cover 23 greatly protrudes towards the +Z side to a degree similar to that of a platen shaft 25 described later. The head cover 23 is inserted into the first head insertion hole 119 when the tape cartridge 101 is mounted in the cartridge mounting portion 7 and guides the mounting of the tape cartridge 101. Furthermore, the head cover 23 is inserted into the second head insertion hole 219 when the ribbon cartridge 201 is mounted in the cartridge mounting portion 7 and guides the mounting of the ribbon cartridge 201.

Figure 6:
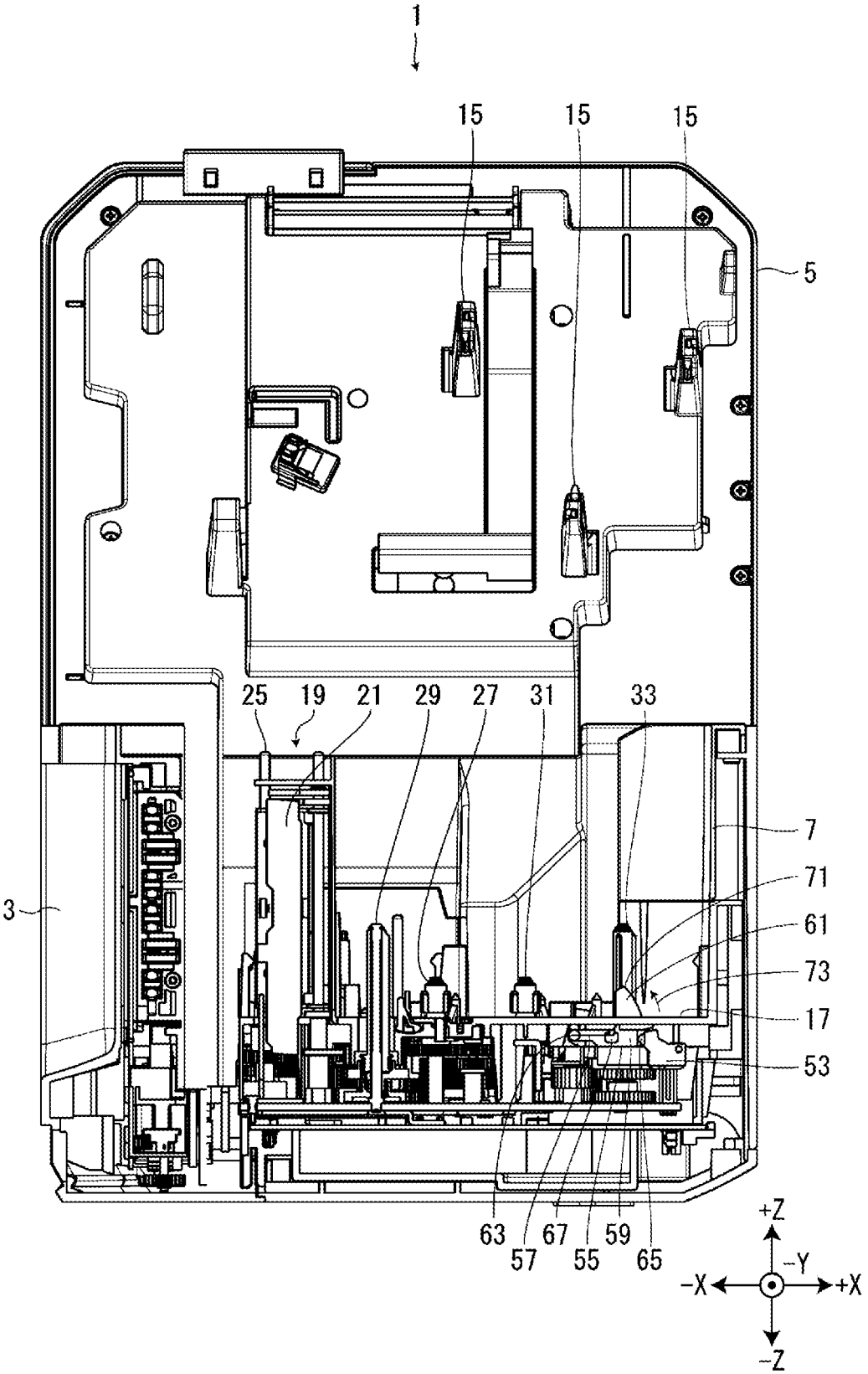
FIG. 6 is a cross-sectional view of the tape printing apparatus in which neither the tape cartridge nor the ribbon cartridge is mounted in the cartridge mounting portion.

Furthermore, in order from the −X side, the platen shaft 25, a first winding shaft 29, a first delivering shaft 27, a second delivering shaft 31, and a second winding shaft 33 protrude towards the +Z side in the mounting bottom surface 17 (see FIG. 6).

The platen shaft 25 is provided on the +Y side of the print head 21. A protrusion amount of the platen shaft 25 towards the +Z side is larger than those of the first delivering shaft 27, the first winding shaft 29, the second delivering shaft 31, and the second winding shaft 33. The platen shaft 25 is inserted into the first platen roller 105 when the tape cartridge 101 is mounted in the cartridge mounting portion 7 and guides the mounting of the tape cartridge 101 together with the head cover 23. Furthermore, the platen shaft 25 is inserted into the second platen roller 205 when the ribbon cartridge 201 is mounted in the cartridge mounting portion 7 and guides the mounting of the ribbon cartridge 201 together with the head cover 23. Note that hereinafter, the direction in which the tape cartridge 101 and the ribbon cartridge 201 are mounted will be referred to as a mounting direction. The mounting direction is parallel to a direction in which the platen shaft 25 extends, or is parallel to the Z direction. Furthermore, an opposite direction to the mounting direction is the +Z side, and the mounting direction is the −Z side.

When the tape cartridge 101 is mounted in the cartridge mounting portion 7, the platen shaft 25, the first delivering shaft 27, and the first winding shaft 29 are inserted into the first platen roller 105, the first paying out core 107, and the first winding core 109, respectively (see FIG. 1). When the mounting portion cover 5 is closed in the above state, a head moving mechanism (not shown) moves the print head 21 towards the platen shaft 25. With the above, the first print tape 113 and the first ink ribbon 117 are pinched between the print head 21 and the first platen roller 105. The tape printing apparatus 1 prints print information input through the keyboard or the like on the first print tape 113 by heating the print head 21 while sending the first print tape 113 and the first ink ribbon 117 by rotating the first platen roller 105.

Furthermore, when the ribbon cartridge 201 is mounted in the cartridge mounting portion 7, the platen shaft 25, the second delivering shaft 31, and the second winding shaft 33 are inserted into the second platen roller 205, the second paying out core 207, and the second winding core 209, respectively (see FIG. 2). When the mounting portion cover 5 is closed in the above state, a head moving mechanism moves the print head 21 towards the platen shaft 25. With the above, the second print tape and the second ink ribbon 217 are pinched between the print head 21 and the second platen roller 205. The tape printing apparatus 1 prints print information input through the keyboard or the like on the second print tape by heating the print head 21 while sending the second print tape and the second ink ribbon 217 by rotating the second platen roller 205.

Six mount protrusions 35 that protrude towards the opposite direction to the mounting direction are provided in a scattered manner at six locations in the mounting bottom surface 17. In other words, four mount protrusions 35 are provided in four corners of a substantially rectangular common area 37 on the −X side in the mounting bottom surface 17, where the tape cartridge 101 and the ribbon cartridge 201 are commonly mounted. Furthermore, two mount protrusions 35 are provided at two portions in a substantially rectangular non-common area 39 on the +X side in the mounting bottom surface 17, where only the ribbon cartridge 201 is mounted. The two mount protrusions 35 are provided at a corner on the +X side and the −Y side, and at an end portion on the +Y side and at a substantially middle portion in the X direction. As described later, the six mount protrusions 35 adjust the mount position of the tape cartridge 101 or the ribbon cartridge 201 in the mounting direction according to the width of the housed first print tape 113 or second print tape.

Four hooks 41 that protrude towards the opposite direction to the mounting direction are provided in a scattered manner at four locations in the mounting bottom surface 17. In other words, two hooks 41 are provided at two portions in the common area 37, namely, at an end portion on the −X side and at a substantially middle portion in the Y direction, and at an end portion on the +X side and at the substantially middle portion in the Y direction. Furthermore, two hooks 41 are provided at two portions in the non-common area 39, namely, at the end portion on the −Y side and at a substantially middle portion in the X direction, and at an end portion on the +X side and at a substantially middle portion in the Y direction.

When the tape cartridge 101 is mounted in the cartridge mounting portion 7, the two hooks 41 provided in the common area 37 are engaged with two first hook engaging portions (not shown) provided in the tape cartridge 101. With the above, the tape cartridge 101 mounted in the cartridge mounting portion 7 is held. Furthermore, when the ribbon cartridge 201 is mounted in the cartridge mounting portion 7, a total of three hooks 41, namely, the hook 41 on the −X side among the two hooks 41 provided in the common area 37, and the two hooks 41 provided in the non-common area 39, are engaged with three second hook engaging portions 231 (see FIGS. 4 and 5) provided in the ribbon cartridge 201. With the above, the ribbon cartridge 201 mounted in the cartridge mounting portion 7 is held.

Furthermore, a first detection portion 43 and a second detection portion 45 are provided on the mounting bottom surface 17. The first detection portion 43 is provided in the common area 37 and on the −Y side of the first delivering shaft 27. The first detection portion 43 includes a first sensor 47 (see FIG. 14), and three protrusion members 49 protruding from the mounting bottom surface 17. A mechanical switch such as, for example, a micro switch can be used as the first sensor 47. The three protrusion members 49 are configured so as to be displaceable in the mounting direction. When the tape cartridge 101 or the ribbon cartridge 201 is mounted in the cartridge mounting portion 7, at least one of the protrusion members 49 pushed by the tape cartridge 101 or the ribbon cartridge 201 is displaced towards the mounting direction. With the above, the first sensor 47 outputs different detection signals according to whether the tape cartridge 101 or the ribbon cartridge 201 has been mounted in the cartridge mounting portion 7. Herein, the detection signal output by the first sensor 47 when the tape cartridge 101 or the ribbon cartridge 201 has been mounted in the cartridge mounting portion 7 is "1". On the other hand, the detection signal output by the first sensor 47 when neither the tape cartridge 101 nor the ribbon cartridge 201 has been mounted in the cartridge mounting portion 7 is "0".

Note that the tape cartridge 101 displaces the three protrusion members 49 towards the mounting direction through different combinations according to the width of the housed first print tape 113. Accordingly, the first detection portion 43 outputs different signals according to the width of the first print tape 113 housed in the mounted tape cartridge 101. In a similar manner, the ribbon cartridge 201 displaces the three protrusion members 49 towards the mounting direction through different combinations according to the width of the housed second print tape. Accordingly, the first detection portion 43 outputs different signals according to the width of the second print tape housed in the mounted ribbon cartridge 201.

The second detection portion 45 is provided in the non-common area 39 and on the −Y side of the second winding shaft 33. Details of the second detection portion 45 will be described later.

Furthermore, a substrate connection portion 51 is provided in inner peripheral surfaces of the cartridge mounting portion 7, which surrounds the +X side of the common area 37. The substrate connection portion 51 is coupled to a circuit substrate 241 (see FIG. 4) provided in the ribbon cartridge 201 when the ribbon cartridge 201 is mounted in the cartridge mounting portion 7. Accordingly, the substrate connection portion 51 outputs different detection signals according to whether the ribbon cartridge 201 has been mounted. Herein, the detection signal output by the substrate connection portion 51 when the ribbon cartridge 201 has been mounted in the cartridge mounting portion 7 is "1". On the other hand, the detection signal output by the substrate connection portion 51 when the ribbon cartridge 201 is not mounted in the cartridge mounting portion 7 is "0".

Incidentally, the circuit substrate 241 is not provided in the tape cartridge 101. Accordingly, when the tape cartridge 101 is mounted, similar to when neither the tape cartridge 101 nor the ribbon cartridge 201 is mounted, the substrate connection portion 51 outputs the detection signal "0". Note that various pieces of information such as, for example, the color of the second print tape, the color of the second ink ribbon 217, and the remaining amounts of the second print tape and the second ink ribbon 217 are stored in the circuit substrate 241 and various pieces of information are written in the circuit substrate 241.

Ribbon Cartridge

A first ribbon cartridge 201*a* in which a second ink ribbon 217 having a large width of 50 mm, for example, is stored (see FIG. 7) and a second ribbon cartridge 201*b* in which a second ink ribbon 217 having a narrow width of 24 mm, for example, is stored (see FIG. 8) are prepared as the ribbon cartridge 201. Note that when the first ribbon cartridge 201*a* and the second ribbon cartridge 201*b* are not distinguished in particular, the first ribbon cartridge 201*a* and the second ribbon cartridge 201*b* will be referred to as a ribbon cartridge 201. The first ribbon cartridge 201*a* and the second ribbon cartridge 201*b* are configured in a substantially same manner, and the drawing of the first ribbon cartridge 201*a* will representatively describe the configurations common to the two. Note that the first ribbon cartridge 201*a* is an example of a "first cartridge", and the second ribbon cartridge 201*b* is an example of a "second cartridge".

Figure 4:
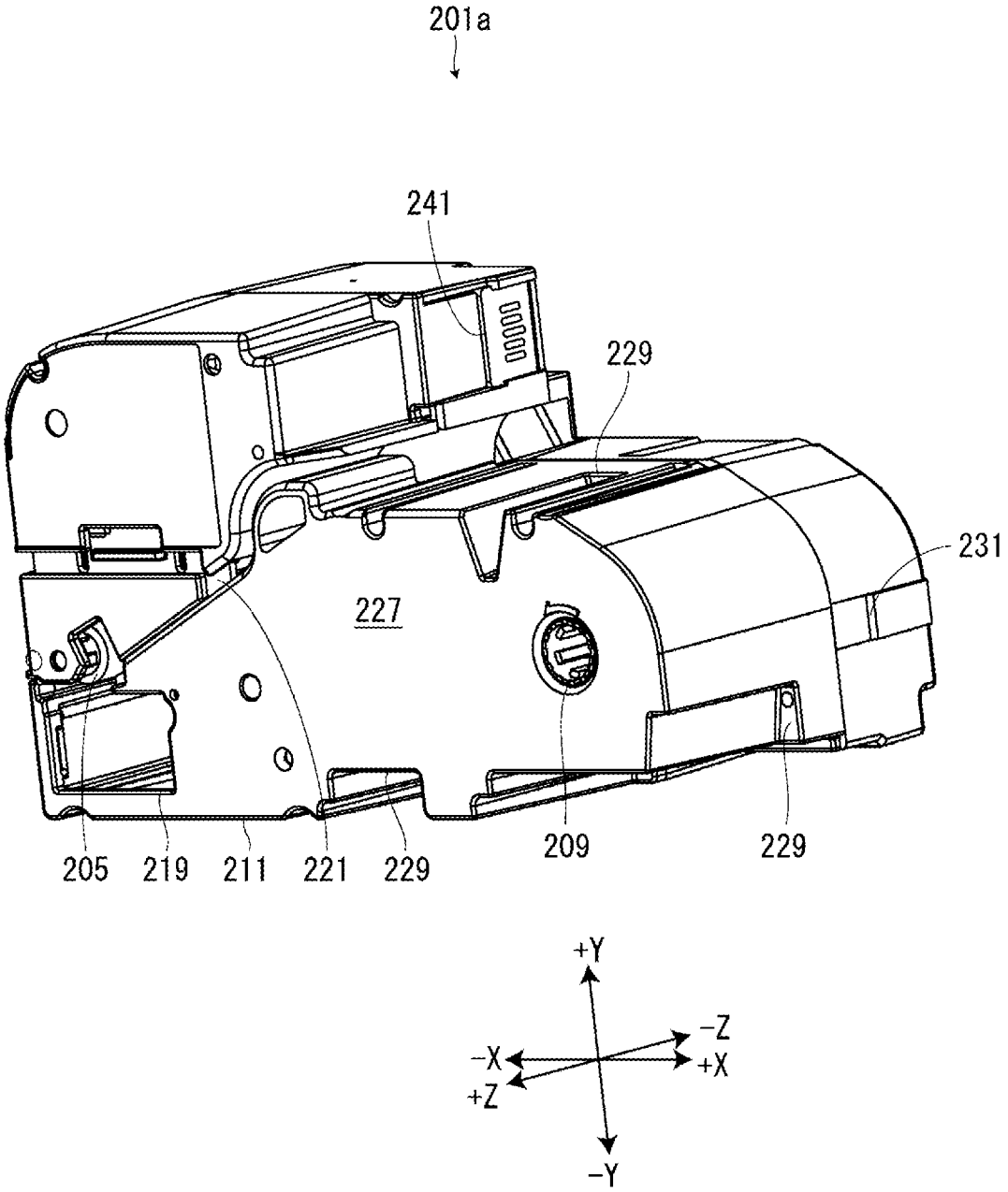
FIG. 4 is a perspective view of the ribbon cartridge.

As illustrated in FIGS. 2 and 4, the ribbon cartridge 201 is formed long in the X direction when viewed from the mounting direction. Three holding recesses 229 recessed towards the mounting direction are provided in a upper-side wall portion 227 that is a wall portion of the second cartridge case 211 on the opposite direction to the mounting direction. The three holding recesses 229 are provided at positions corresponding to the three holding protrusions 15 provided in the mounting portion cover 5. Furthermore, when viewed from the mounting direction, the three holding recesses 229 are provided so as to surround the second paying out core 207 and the second winding core 209.

When the mounting portion cover 5 is closed while in a state in which the ribbon cartridge 201 is mounted in the cartridge mounting portion 7, the three holding protrusions 15 provided in the mounting portion cover 5 abut against the bottom surfaces of the three holding recesses 229 or against the surfaces in the mounting direction. With the above, the ribbon cartridge 201 is urged towards the mounting direction with the three holding protrusions 15.

Furthermore, the three second hook engaging portions 231 are provided in the peripheral wall portions of the second cartridge case 211. When the ribbon cartridge 201 is mounted in the cartridge mounting portion 7, as described above, the three second hook engaging portions 231 engage with the three hooks 41 among the four hooks 41 provided in the cartridge mounting portion 7.

Figure 5:
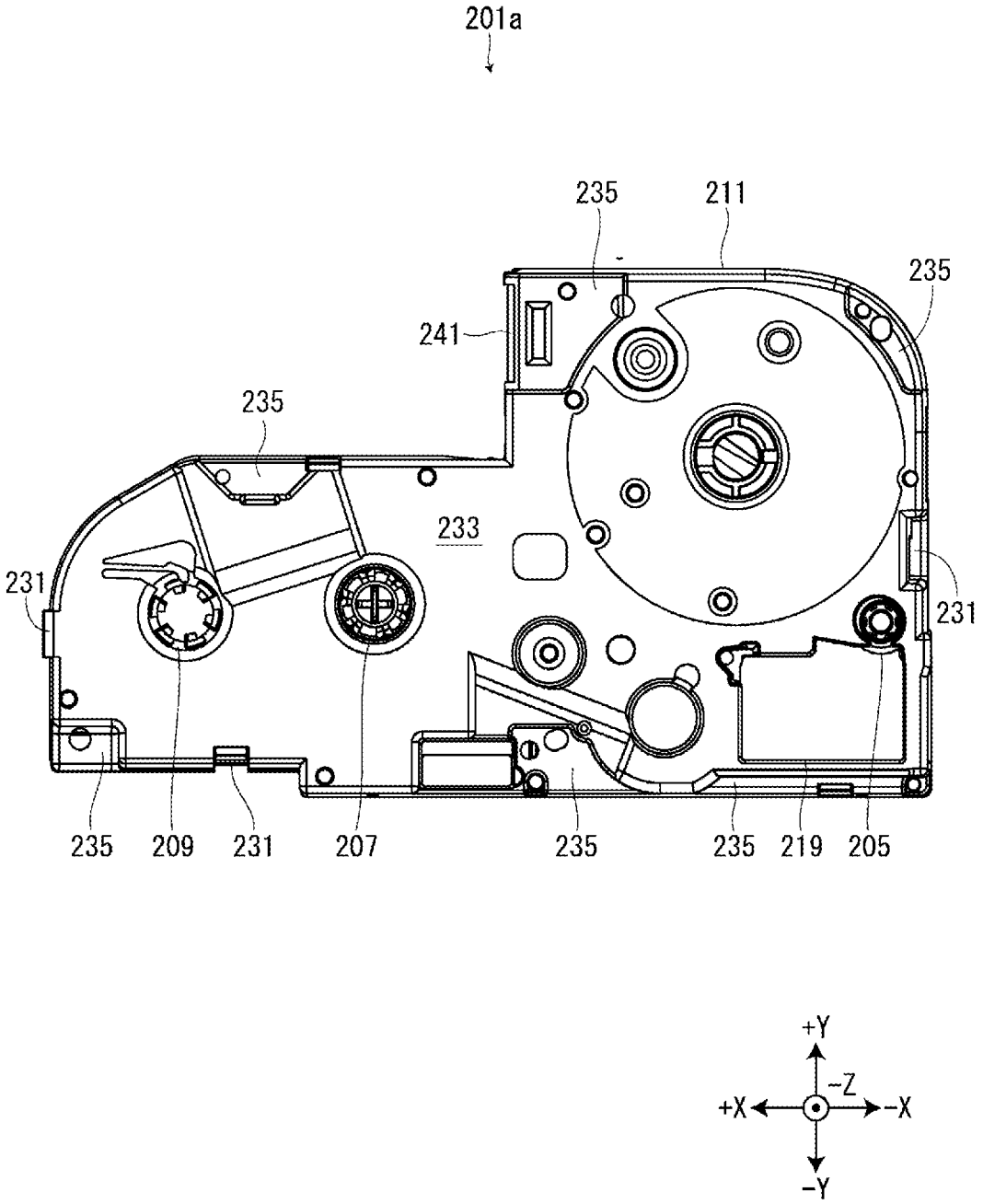
FIG. 5 is a diagram of the ribbon cartridge viewed from an opposite direction to the mounting direction.

As illustrated in FIG. 5, in the first ribbon cartridge 201*a*, six case recessed portions 235 recessed towards the opposite direction to the mounting direction are provided in a lower-side wall portion 233, which is a wall portion of the second cartridge case 211 in the mounting direction, so as to correspond to the mount protrusions 35 provided at six portions in the mounting bottom surface 17. Accordingly, when the first ribbon cartridge 201*a* is mounted in the cartridge mounting portion 7, the mount protrusions 35 are fitted to the case recessed portions 235 so that the lower-side wall portion 233 is in contact with the mounting bottom surface 17 (see FIG. 7).

Incidentally, while not illustrated in the drawings, the second ribbon cartridge 201*b* is not provided with the recessed portions, such as the case recessed portions 235, in the lower-side wall portion 233. Accordingly, when the second ribbon cartridge 201*b* is mounted in the cartridge mounting portion 7, the six portions in the lower-side wall portion 233 corresponding to the six mount protrusions 35 are mounted on the mount protrusions 35 so that a gap is created between the lower-side wall portion 233 and the mounting bottom surface 17 such that the lower-side wall portion 233 is raised from the mounting bottom surface 17 (see FIG. 8).

Figure 8:
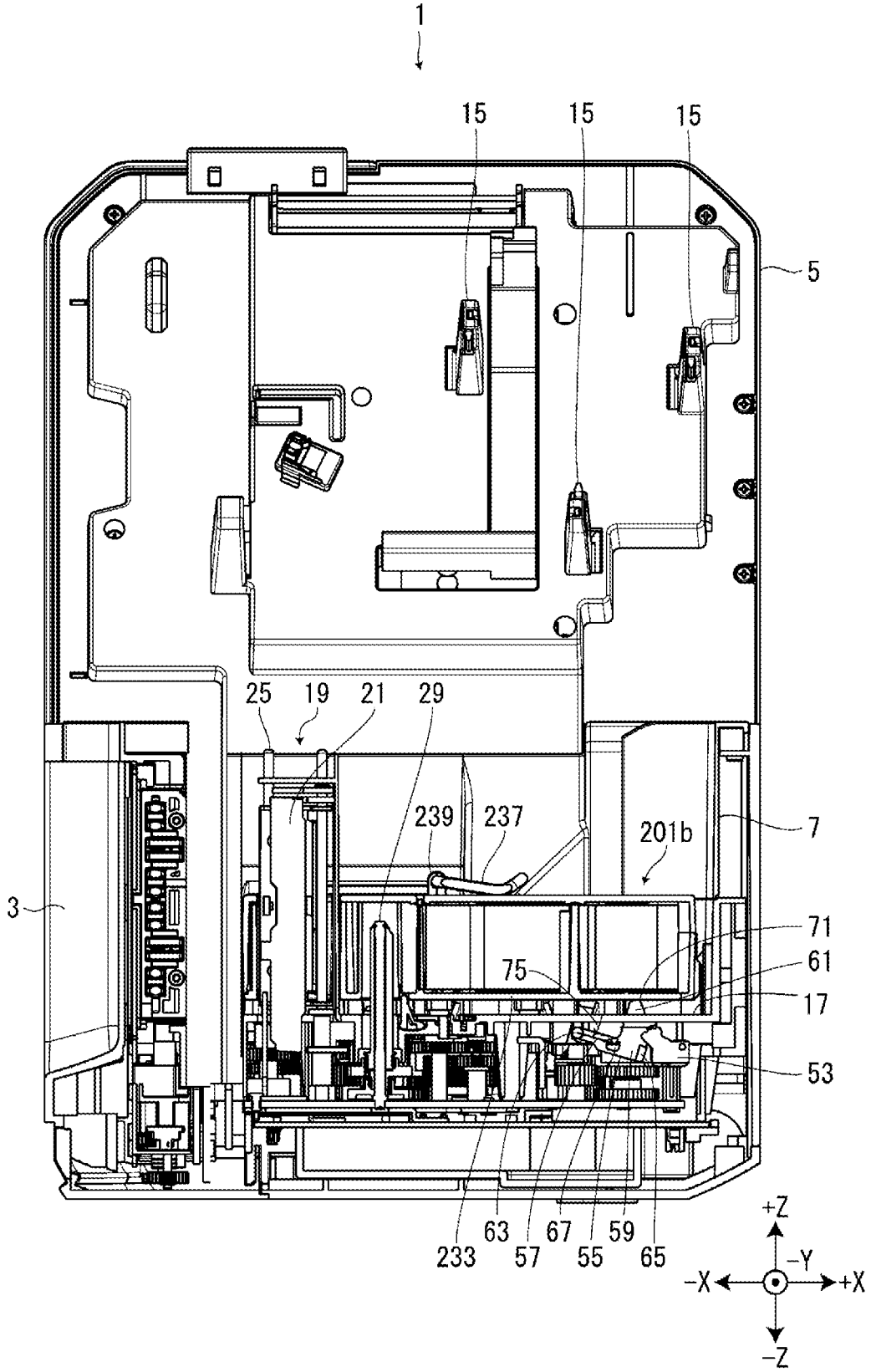
FIG. 8 is a cross-sectional view of the tape printing apparatus in which a second ribbon cartridge is mounted in the cartridge mounting portion.

Note that compared with the first ribbon cartridge 201*a*, the second ribbon cartridge 201*b* is, in the cartridge mounting portion 7, mounted in the mounting direction; accordingly, it is relatively difficult to detach the second ribbon cartridge 201*b* from the cartridge mounting portion 7 by just holding the peripheral wall portion of the second cartridge case 211. Accordingly, as illustrated in FIG. 8, in the second ribbon cartridge 201*b*, a finger hooking portion 237 for hooking a finger when detaching the second ribbon cartridge 201*b* from the cartridge mounting portion 7 is provided in the upper-side wall portion 227. The finger hooking portion 237 is formed in a substantially ring shape and is pivotably attached to a finger hook attaching portion 239 provided in a substantially middle portion of the upper-side wall portion 227. The user can easily detach the second ribbon cartridge 201*b* from the cartridge mounting portion 7 by hooking a finger in the finger hooking portion 237 and lifting the second ribbon cartridge 201*b*.

Second Detection Portion

As illustrated in FIG. 6, the second detection portion 45 includes a second sensor 53, a displacement member 55, and a detection spring 57. The second sensor 53 is built-in in the mounting direction of the cartridge mounting portion 7. A mechanical switch such as, for example, a micro switch can be used as the second sensor 53.

The displacement member 55 is provided on the −X side of the second sensor 53. The displacement member 55 is formed in a substantially "L" shape when viewed from the −Y side, and includes a first displacement portion 59 that extends in the X direction and a second displacement portion 61 that is bent and that extends from an end portion of the first displacement portion 59 on the +X side towards the opposite direction to the mounting direction. The displacement member 55 is pivotably supported by a detection shaft 63. The detection shaft 63 extends in the Y direction and is inserted through an end portion of the first displacement portion 59 on the −X side. The displacement member 55 is displaced in the mounting direction by pivoting about the detection shaft 63.

A sensor engagement portion 65 that engages with the second sensor 53 is provided in the end portion of the first displacement portion 59 on the +X side. A spring hooking portion 67 is provided in substantially the middle portion between the detection shaft 63 and the sensor engagement portion 65. When the displacement member 55 is pivoted, the second displacement portion 61 appears through a detection opening 69 (see FIG. 3) provided in the mounting bottom surface 17. A cartridge abutment portion 71 is provided at an end portion of the second displacement portion 61 on the opposite direction to the mounting direction. When the ribbon cartridge 201 is mounted in the cartridge mounting portion 7, the lower-side wall portion 233 of the second cartridge case 211 abuts against the cartridge abutment portion 71.

The detection spring 57 is provided on the detection shaft 63 and one end thereof is hooked to the spring hooking portion 67. A torsion coil spring, for example, can be used as the detection spring 57. The detection spring 57 applies force to the displacement member 55 so that the displacement member 55 pivots in a first direction 73 or so that the displacement member 55 is displaced towards the opposite direction to the mounting direction. Note that the first direction 73 extends counterclockwise when viewed from the −Y side. Note that the detection spring 57 is an example of an "elastic member".

As illustrated in FIG. 6, when the ribbon cartridge 201 is not mounted in the cartridge mounting portion 7, since force is applied to the displacement member 55 in the first direction 73 with the detection spring 57, the second displacement portion 61 protrudes towards the opposite direction to the mounting direction with respect to the mounting bottom surface 17. The above position of the displacement member 55 is referred to as a protruded position. When the displacement member 55 is positioned at the protruded position, the sensor engagement portion 65 is engaged with the second sensor 53. The detection signal output by the second sensor 53 in the above state is "0".

Figure 7:
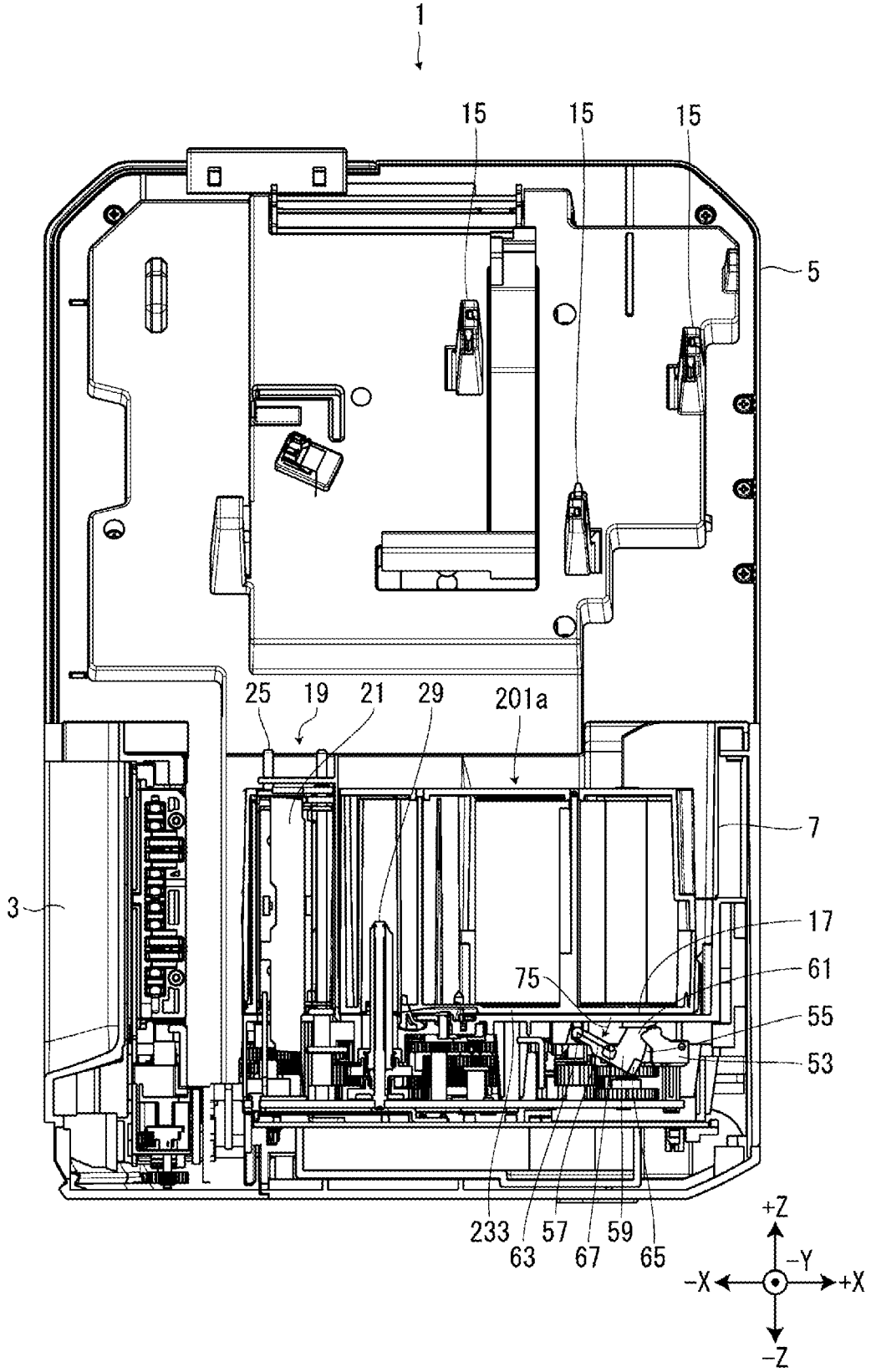
FIG. 7 is a cross-sectional view of the tape printing apparatus in which a first ribbon cartridge is mounted in the cartridge mounting portion.

When the first ribbon cartridge 201*a* is mounted in the cartridge mounting portion 7, from the state illustrated in FIG. 6, the lower-side wall portion 233 of the first ribbon cartridge 201*a* abuts against the cartridge abutment portion 71 and the displacement member 55 that is pushed by the first ribbon cartridge 201*a* towards the mounting direction and that counters the detection spring 57 pivots in a second direction 75 that is opposite the first direction 73; accordingly, a state illustrated in FIG. 7 is reached. The second direction 75 extends clockwise when viewed from the −Y side.

As described above, when the first ribbon cartridge 201*a* is mounted in the cartridge mounting portion 7, the lower-side wall portion 233 comes in contact with the mounting bottom surface 17. Accordingly, the second displacement portion 61 sinks towards the mounting direction with respect to the mounting bottom surface 17. The above position of the displacement member 55 is referred to as a first lower-side position. When the displacement member 55 is positioned at the first lower-side position, the sensor engagement portion 65 is separated from the second sensor 53 towards the mounting direction. The detection signal output by the second sensor 53 in the above state is "1".

When the second ribbon cartridge 201*b* is mounted in the cartridge mounting portion 7, from the state illustrated in FIG. 6, the lower-side wall portion 233 of the second ribbon cartridge 201*b* abuts against the cartridge abutment portion 71 and the displacement member 55 that is pushed by the second ribbon cartridge 201*b* towards the mounting direction and that counters the detection spring 57 pivots in the second direction 75; accordingly, a state illustrated in FIG. 8 is reached. As described above, when the second ribbon cartridge 201*b* is mounted in the cartridge mounting portion 7, the lower-side wall portion 233 is raised from the mounting bottom surface 17. Accordingly, while the second displacement portion 61 sinks towards the mounting direction with respect to the mounting bottom surface 17, a portion thereof is left protruded towards the opposite direction to the mounting direction with respect to the mounting bottom surface 17. The above position of the displacement member 55 is referred to as a second lower-side position. The second lower-side position is on the mounting direction with respect to the protruded position and is on the opposite direction to the mounting direction with respect to the first lower-side position. When the displacement member 55 is positioned at the second lower-side position, the sensor engagement portion 65 is separated from the second sensor 53 towards the mounting direction. Accordingly, similar to when the first ribbon cartridge 201*a* is mounted in the cartridge mounting portion 7, the second sensor 53 outputs "1" as the detection signal.

Figure 9:
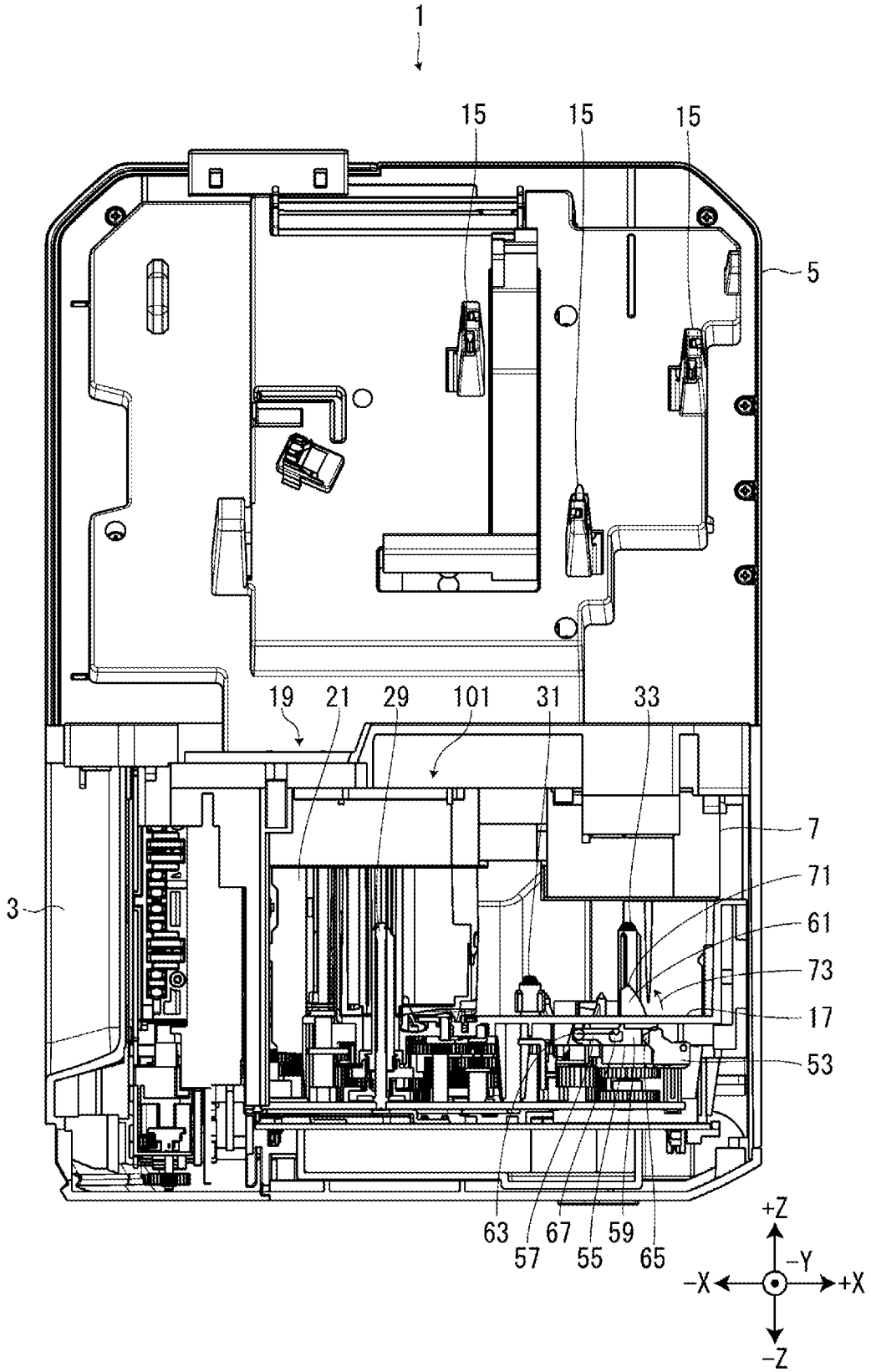
FIG. 9 is a cross-sectional view of the tape printing apparatus in which the tape cartridge is mounted in the cartridge mounting portion.

Note that when the tape cartridge 101 is mounted in the cartridge mounting portion 7, as illustrated in FIG. 9, the tape cartridge 101 does not abut against the cartridge abutment portion 71; accordingly, the displacement member 55 remains at the protruded position. Accordingly, similar to when neither the tape cartridge 101 nor the ribbon cartridge 201 is mounted in the cartridge mounting portion 7, the second sensor 53 outputs "0" as the detection signal.

Figure 10:
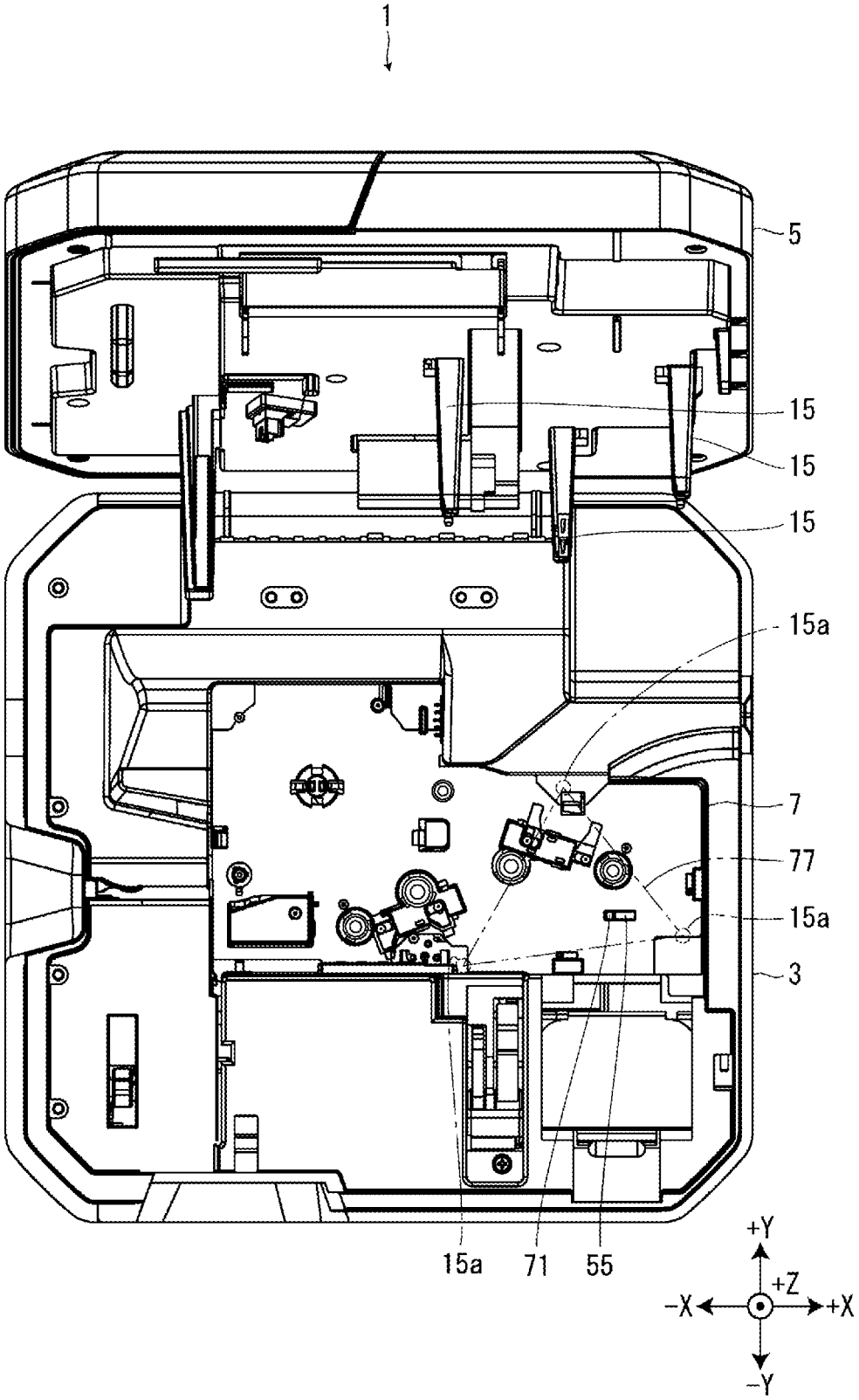
FIG. 10 is a diagram illustrating a cartridge abutment portion being provided inside a virtual holding triangle.

Note that as illustrated in FIG. 10, when viewed from the mounting direction, the cartridge abutment portion 71 is provided inside a virtual holding triangle 77. Note that the virtual holding triangle 77 is a virtual triangle in which holding distal end portions 15*a*, which are distal end portions of the three holding protrusions 15, are the apexes when the mounting portion cover 5 is closed. When viewed from the mounting direction, the ribbon cartridge 201 mounted in the cartridge mounting portion 7 is held at three positions surrounding the cartridge abutment portion 71 by the three holding protrusions 15. Accordingly, the ribbon cartridge 201 that has been pushed towards the opposite direction to the mounting direction by the displacement member 55 to which force has been applied towards the opposite direction to the mounting direction by the detection spring 57 can be suppressed from being positionally deviated towards the opposite direction to the mounting direction with respect to the desired mounting position. Note that while in FIG. 10, the mounting portion cover 5 is open, the holding distal end portions 15*a* when the mounting portion cover 5 is closed are virtually illustrated by dashed line circles.

Figure 11:
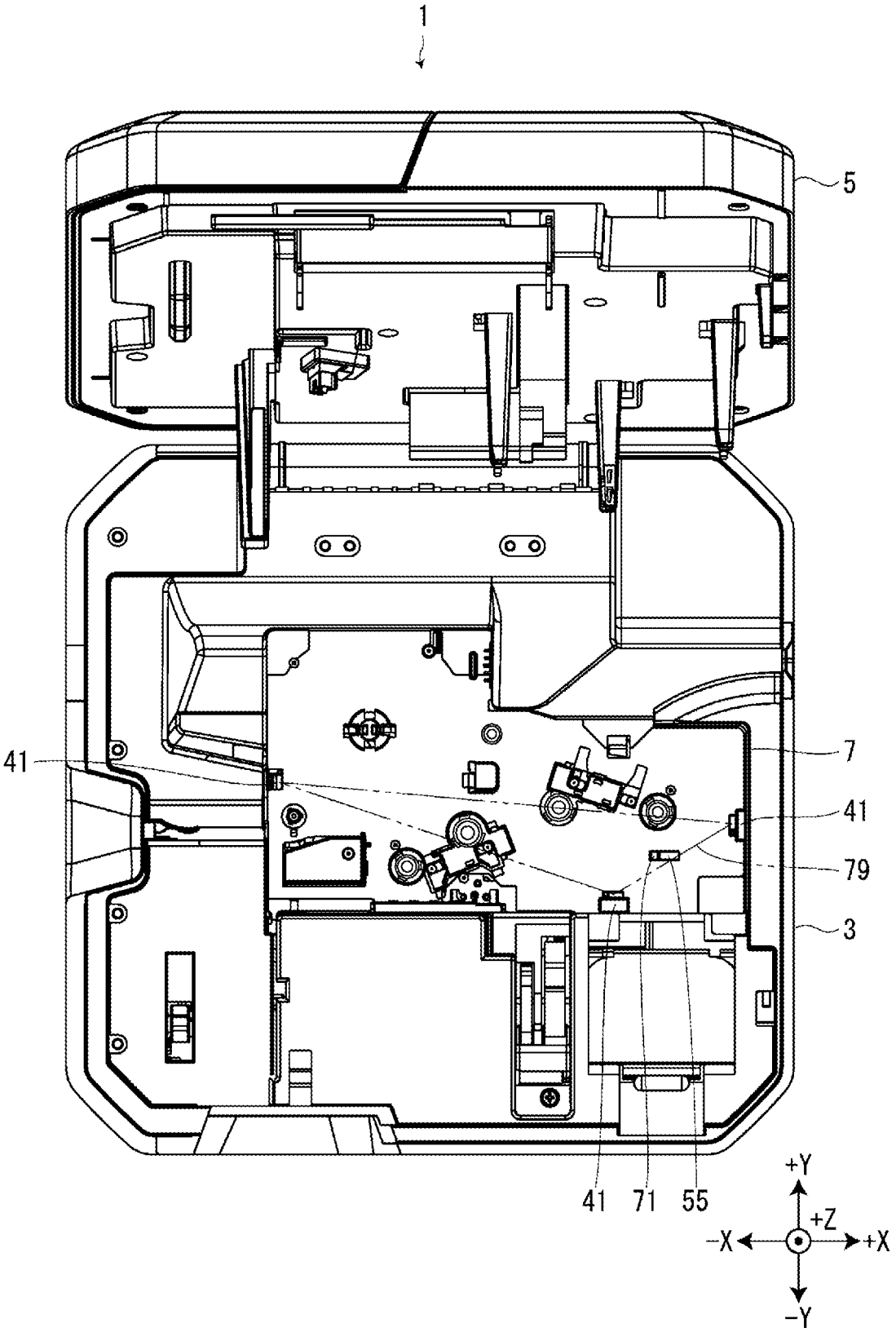
FIG. 11 is a diagram illustrating the cartridge abutment portion being provided inside a virtual hook triangle.

As illustrated in FIG. 11, when viewed from the mounting direction, the cartridge abutment portion 71 is provided inside a virtual hook triangle 79 or within an area overlapping the virtual hook triangle 79. Note that the virtual hook triangle 79 is a virtual triangle having distal end portions of the three hooks 41, which are engaged with the three second hook engaging portions 231 provided in the ribbon cartridge 201, as the apexes. When viewed from the mounting direction, the ribbon cartridge 201 mounted in the cartridge mounting portion 7 is held at the three positions surrounding the cartridge abutment portion 71 by the three hooks 41. Accordingly, with the above configuration as well, the ribbon cartridge 201 that has been pushed towards the opposite direction to the mounting direction by the displacement member 55 can be suppressed from being positionally deviated towards the opposite direction to the mounting direction with respect to the desired mounting position.

Figure 12:
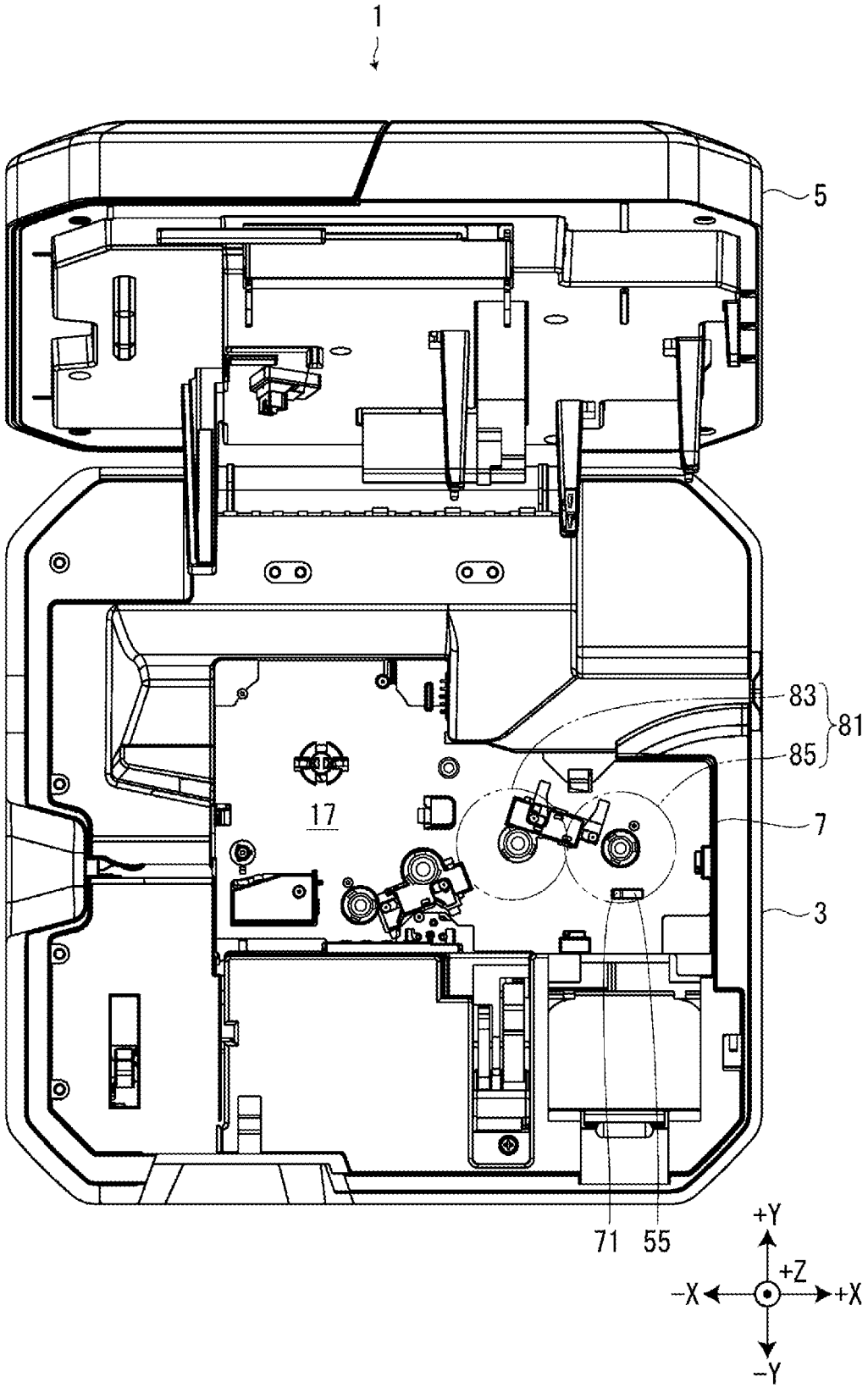
FIG. 12 is a diagram illustrating the cartridge abutment portion being provided in a ribbon overlapping area.

As illustrated in FIG. 12, when viewed from the mounting direction, the cartridge abutment portion 71 is provided in a ribbon overlapping area 81. Note that the ribbon overlapping area 81 is, when viewed from the mounting direction, an area in the mounting bottom surface 17 including a paying-out-side ribbon overlapping area 83 that overlaps the maximum-diameter paying-out-side roll 223 (see FIG. 2) and a winding-side ribbon overlapping area 85 that overlaps the maximum-diameter winding-side roll 225 (see FIG. 2). Since the second ink ribbon 217 wound around the second paying out core 207 or the second winding core 209 is positioned on the opposite direction to the mounting direction with respect to the displacement member 55, the force of the displacement member 55 pushing the ribbon cartridge 201 towards the opposite direction to the mounting direction is canceled out by the weight of the wound second ink ribbon 217. Accordingly, with the above configuration as well, the ribbon cartridge 201 that has been pushed towards the opposite direction to the mounting direction by the displacement member 55 can be suppressed from being positionally deviated towards the opposite direction to the mounting direction with respect to the desired mounting position. Note that while in FIG. 12, the paying-out-side ribbon overlapping area 83 and the winding-side ribbon overlapping area 85 partially overlap each other, the paying-out-side ribbon overlapping area 83 and the winding-side ribbon overlapping area 85 may not overlap each other and may be separated from each other.

Figure 13:
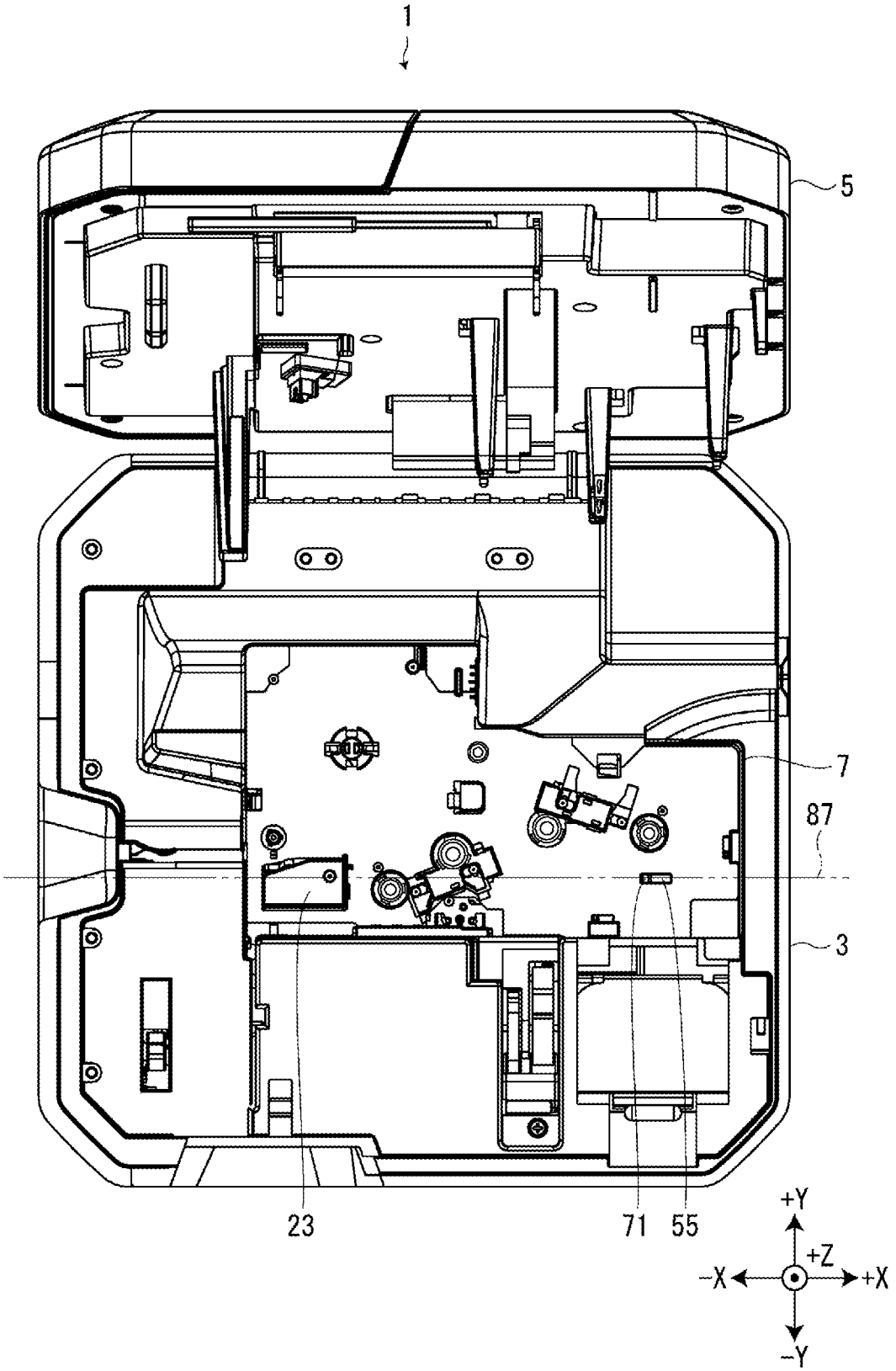
FIG. 13 is a diagram illustrating the cartridge abutment portion being provided on a virtual line passing through a head cover.

As illustrated in FIG. 13, when viewed from the mounting direction, the cartridge abutment portion 71 is provided on a virtual line 87 that passes through the head cover 23 and that extends in the longitudinal direction of the ribbon cartridge 201 or in the X direction. As described above, since the cartridge abutment portion 71 is provided at a position that, in the longitudinal direction of the ribbon cartridge 201, overlaps the head cover 23 that protrudes greatly towards the opposite direction to the mounting direction, the ribbon cartridge 201 is suppressed from inclining in the longitudinal direction. Accordingly, with the above configuration as well, the ribbon cartridge 201 that has been pushed towards the opposite direction to the mounting direction by the displacement member 55 can be suppressed from being positionally deviated towards the opposite direction to the mounting direction with respect to the desired mounting position.

Control Unit

Figure 14:
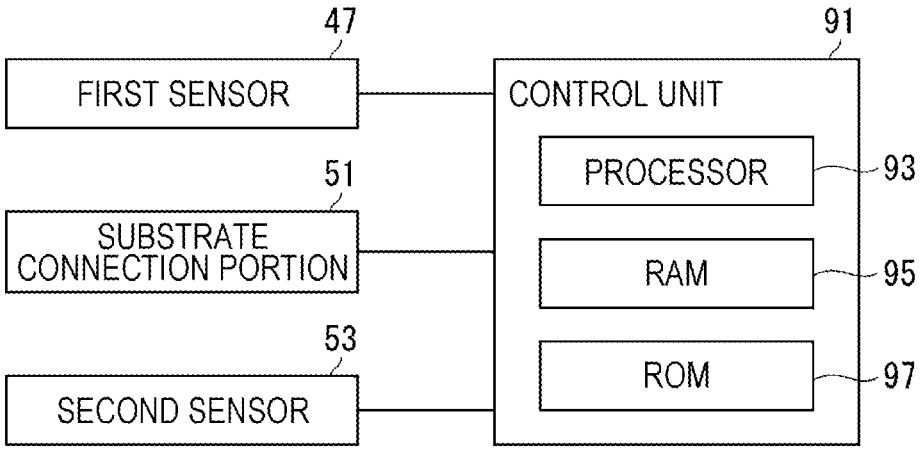
FIG. 14 is a block diagram illustrating a control system of the tape printing apparatus.

As illustrated in FIG. 14, the tape printing apparatus 1 includes a control unit 91. The control unit 91 integrally controls each component of the tape printing apparatus 1. The control unit 91 includes a processor 93, a representative example thereof being a central processing unit (CPU), and various memories such as a random access memory (RAM) 95 and a read-only memory (ROM) 97. The processor 93 reads out a control program stored in the ROM 97 and executes the control program using the RAM 95.

As illustrated in FIG. 15, the control unit 91 determines whether the tape cartridge 101 or the ribbon cartridge 201 is appropriately mounted in the cartridge mounting portion 7 based on a combination of a detection signal output from the first sensor 47, a detection signal output from the substrate connection portion 51, and a detection signal output from the second sensor 53. Hereinafter, for the sake of description, the above combination of the detection signals will be denoted as, for example, "0, 1, 0" when the detection signal output from the first sensor 47 is "0", the detection signal output from the substrate connection portion 51 is "1", and the detection signal output from the second sensor 53 is "0".

When the combination of the detection signals is "0, 0, 0", the control unit 91 determines that neither the tape cartridge 101 nor the ribbon cartridge 201 is mounted in the cartridge mounting portion 7. When the combination of the detection signals is "1, 0, 0", the control unit 91 determines that the tape cartridge 101 is appropriately mounted in the cartridge mounting portion 7. When the combination of the detection signals is "1, 1, 1", the control unit 91 determines that the ribbon cartridge 201 is appropriately mounted in the cartridge mounting portion 7. When the combination of the detection signals is "1, 0, 1", the control unit 91 determines that there is an abnormality in the circuit substrate 241 provided in the ribbon cartridge 201. When the combination of the detection signals is either one of "1, 1, 0", "0, 1, 1", "0, 1, 0", and "0, 0, 1", the control unit 91 determines that while the ribbon cartridge 201 has been mounted in the cartridge mounting portion 7, there is an abnormality in the mounting. Note that the control unit 91 can make a notifying device, such as a display, notify the determination results and the messages related to the determination results. Furthermore, the detection signals "1" and "0" may be reversed or the detection signals may be expressed by other pieces of information in place of "1" and "0".

As described above, in the tape printing apparatus 1 of the present exemplary embodiment, since the cartridge abutment portion 71 is provided inside the virtual holding triangle 77, even when the ribbon cartridge 201 is pushed towards the opposite direction to the mounting direction with the displacement member 55, the ribbon cartridge 201 can be suppressed from being positionally deviated towards the opposite direction to the mounting direction with respect to the desired mounting position. Accordingly, printing can be performed at an appropriate position on the second print tape and the second print tape and the second ink ribbon 217 can be sent out accurately.

Other Modifications

Not limited to the exemplary embodiment described above, it goes without saying that various configurations that do not depart from the scope of the present disclosure can be adopted. For example, the exemplary embodiment described above can be, other than that described above, changed into the following configurations.

The mounting portion cover 5 may have four or more holding protrusions 15 that, when the mounting portion cover 5 is closed, holds the ribbon cartridge 201 mounted in the cartridge mounting portion 7. In other words, it is only sufficient that the cartridge abutment portion 71 is provided inside the virtual holding triangle 77 having the distal end portions of any of the three holding protrusions 15 among the four or more holding protrusions 15 serve as apexes.

The displacement member 55 is not limited to a pivoting configuration and, for example, may be configured to move parallel to the mounting direction.

The cartridge mounting portion 7 is not limited to a configuration in which the tape cartridge 101 and the ribbon cartridge 201 are selectively mounted. The cartridge mounting portion 7 may be configured so that the ribbon cartridge 201 alone is mounted thereto. Furthermore, similar to the tape cartridge 101, the ribbon cartridge 201 may be configured to house the tape, which is the object of printing.

Furthermore, the exemplary embodiment described above and the modifications may be combined.

Additional Note

Hereinafter, additional statements of the tape printing apparatus will be given.

The tape printing apparatus includes a cartridge mounting portion in which the cartridge is mounted, a mounting portion cover that opens/closes the cartridge mounting portion, three holding protrusions provided on the mounting portion cover, while in a state in which the cartridge is mounted in the cartridge mounting portion, when the mounting portion cover is closed, the three holding protrusions hold the cartridge, a displacement member that includes a cartridge abutment portion against which the cartridge abuts when the cartridge is mounted in the cartridge mounting portion, the displacement member being displaced from a protruded position, in which the displacement member protrudes from a mounting bottom surface or a bottom surface of the cartridge mounting portion, to a lower-side position, in which the displacement member is displaced from the protruded position towards a mounting direction of the cartridge, by having the cartridge abut against the cartridge abutment portion, and an elastic member that applies force to the displacement member towards an opposite direction to the mounting direction. In the tape printing apparatus, when viewed from the mounting direction, the cartridge abutment portion is provided inside a virtual holding triangle having distal end portions of the three holding protrusions serve as apexes when the mounting portion cover is in a closed state.

According to such a configuration, when viewed from the mounting direction, the cartridge mounted in the cartridge mounting portion is held at three positions surrounding the cartridge abutment portion with the three holding protrusions. Accordingly, the cartridge that has been pushed towards the opposite direction to the mounting direction by the displacement member to which force has been applied towards the opposite direction to the mounting direction by the elastic member can be suppressed from being positionally deviated towards the opposite direction to the mounting direction with respect to the desired mounting position.

In such a case, desirably, a sensor that outputs different detection signals when the displacement member is at the protruded position and when the displacement member is at the lower-side position is included.

According to such a configuration, a detection of whether the cartridge is mounted in the cartridge mounting portion can be performed based on a detection signal output from the sensor.

In such a case, desirably, the cartridge mounting portion is configured to selectively mount a non-contact cartridge that does not abut against the cartridge abutment portion when mounted in the cartridge mounting portion, and the cartridge.

According to such a configuration, a detection of the carriage being mounted and the non-contact cartridge not being mounted in the cartridge mounting portion can be performed based on the detection signal output from the sensor.

In such a case, desirably, the cartridge includes a first cartridge that, when mounted in the cartridge mounting portion, displaces the displacement member to a first lower-side position that is on the mounting direction with respect to the protruded position, and a second cartridge that, when mounted in the cartridge mounting portion, displaces the displacement member to a second lower-side position that is on the lower side in the mounting direction with respect to the protruded position and that is on the opposite direction to the mounting direction with respect to the first lower-side position, and both when the displacement member is at the first lower-side position and when the displacement member is at the second lower-side position, the sensor outputs detection signals that are different from a detection signal output when the displacement member is at the protruded position.

With such a configuration, when either of the first cartridge and the second cartridge is mounted in the cartridge mounting portion, a detection of the first cartridge or the second cartridge being mounted in the cartridge mounting portion can be performed.

In such a case, desirably, the cartridge houses a paying out core around which an ink ribbon is wound and a winding core that winds the ink ribbon sent out from the paying out core, and the cartridge abutment portion is provided in a ribbon overlapping area configured of a paying-out-side ribbon overlapping area in the mounting bottom surface that, when viewed from the mounting direction, overlaps the ink ribbon wound around the paying out core when the cartridge in which an entire ink ribbon is wound around the paying out core is mounted in the cartridge mounting portion, and a winding-side ribbon overlapping area in the mounting bottom surface that, when viewed from the mounting direction, overlaps the ink ribbon wound around the winding core when the cartridge in which an entire ink ribbon is wound around the winding core is mounted in the cartridge mounting portion.

According to such a configuration, the force of the displacement member pushing the cartridge towards the opposite direction to the mounting direction is canceled out by the weight of the wound ink ribbon. Accordingly, the cartridge that has been pushed towards the opposite direction to the mounting direction by the displacement member can be suppressed in a more effective manner from being positionally deviated towards the opposite direction to the mounting direction with respect to the desired mounting position.

In such a case, desirably, a head cover that protrudes towards the opposite direction to the mounting direction from the mounting bottom surface and that is inserted into the head insertion hole provided in the cartridge is included and when viewed from the mounting direction, desirably, the cartridge abutment portion is provided on a virtual line that passes through the head cover and that extends in a longitudinal direction of the cartridge.

According to such a configuration, since the cartridge pushed by the displacement member towards the opposite direction to the mounting direction can be suppressed from inclining towards the longitudinal direction of the cartridge, the cartridge can be suppressed in a further effective manner from being positionally deviated towards the opposite direction to the mounting direction with respect to the desired mounting position.

What is claimed is:

1. A tape printing apparatus comprising:

a cartridge mounting portion in which the cartridge is mounted;

a mounting portion cover that opens/closes the cartridge mounting portion;

three holding protrusions provided on the mounting portion cover, while in a state in which the cartridge is mounted in the cartridge mounting portion, when the mounting portion cover is closed, the three holding protrusions hold the cartridge;

a displacement member that includes a cartridge abutment portion against which the cartridge abuts when the cartridge is mounted in the cartridge mounting portion, the displacement member being displaced from a protruded position, in which the displacement member protrudes from a mounting bottom surface or a bottom surface of the cartridge mounting portion, to a lower-side position, in which the displacement member is displaced from the protruded position towards an opposite direction to a mounting direction of the cartridge, by having the cartridge abut against the cartridge abutment portion; and an elastic member that applies force to the displacement member towards an opposite direction to the mounting direction, wherein when viewed from the mounting direction, the cartridge abutment portion is provided inside a virtual holding triangle having distal end portions of the three holding protrusions serve as apexes when the mounting portion cover is in a closed state.

2. The tape printing apparatus according to claim 1, further comprising:

a sensor that outputs different detection signals when the displacement member is at the protruded position and when the displacement member is at the lower-side position.

3. The tape printing apparatus according to claim 2, wherein the cartridge mounting portion is configured to selectively mount a non-contact cartridge that does not abut against the cartridge abutment portion when mounted in the cartridge mounting portion, and the cartridge.

4. The tape printing apparatus according to claim 2, wherein the cartridge includes a first cartridge that, when mounted in the cartridge mounting portion, displaces the displacement member to a first lower-side position that is on the lower side in the mounting direction with respect to the protruded position, and a second cartridge that, when mounted in the cartridge mounting portion, displaces the displacement member to a second lower-side position that is on the mounting direction with respect to the protruded position and that is on opposite direction to the mounting direction with respect to the first lower-side position, and both when the displacement member is at the first lower-side position and when the displacement member is at the second lower-side position, the sensor outputs detection signals that are different from a detection signal output when the displacement member is at the protruded position.

5. The tape printing apparatus according to claim 1, wherein the cartridge houses a paying out core around which an ink ribbon is wound and a winding core that winds the ink ribbon sent out from the paying lower core, and the cartridge abutment portion is provided in a ribbon overlapping area configured of a paying-out-side ribbon overlapping area in the mounting bottom surface that, when viewed from the the mounting direction, overlaps the ink ribbon wound around the paying out core when the cartridge in which an entire ink ribbon is wound around the paying out core is mounted in the cartridge mounting portion, and a winding-side ribbon overlapping area in the mounting bottom surface that, when viewed from the mounting direction, overlaps the ink ribbon wound around the winding core when the cartridge in which an entire ink ribbon is wound around the winding core is mounted in the cartridge mounting portion.

6. The tape printing apparatus according to claim 1, further comprising:

a head cover that protrudes towards the the mounting direction from the mounting bottom surface and that is inserted into the head insertion hole provided in the cartridge, wherein when viewed from the mounting direction, the cartridge abutment portion is provided on a virtual line that passes through the head cover and that extends in a longitudinal direction of the cartridge.

* * * * *